US010287048B2

(12) United States Patent
Sytema et al.

(10) Patent No.: US 10,287,048 B2
(45) Date of Patent: May 14, 2019

(54) SYSTEM AND METHOD FOR AUTOMATICALLY PACKAGING ITEMS VARYING IN SIZE AND NUMBER FOR SHIPMENT

(71) Applicant: NEOPOST TECHNOLOGIES, Bagneux (FR)

(72) Inventors: Herman Sytema, Bagneux (FR); Frank Bosveld, Bagneux (FR); Joost Zeilstra, Bagneux (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 15/329,042

(22) PCT Filed: Oct. 16, 2015

(86) PCT No.: PCT/EP2015/074029
§ 371 (c)(1),
(2) Date: Jan. 25, 2017

(87) PCT Pub. No.: WO2016/059218
PCT Pub. Date: Apr. 21, 2016

(65) Prior Publication Data

US 2017/0210500 A1 Jul. 27, 2017

(30) Foreign Application Priority Data

Oct. 16, 2014 (DE) ..... 10 2014 115 103

(51) Int. Cl.
*B65B 59/00* (2006.01)
*B65B 11/00* (2006.01)
(Continued)

(52) U.S. Cl.
CPC ..... *B65B 59/00* (2013.01); *B65B 11/004* (2013.01); *B65B 11/20* (2013.01); *B65B 43/126* (2013.01);
(Continued)

(58) Field of Classification Search
CPC ..... B65B 5/028
See application file for complete search history.

(56) References Cited

U.S. PATENT DOCUMENTS 2,224,841 A * 12/1940 Berry ..... B65B 51/046 229/125.37
3,217,868 A * 11/1965 Champlin ..... B65D 5/542 206/424
(Continued)

FOREIGN PATENT DOCUMENTS

DE 441848 C 3/1927
DE 694 04 256 T2 11/1997
(Continued)

OTHER PUBLICATIONS

International Search Report, dated Jan. 11, 2016, for corresponding PCT/EP2015/074029, 2 pages.
(Continued)

*Primary Examiner* — Hemant Desai
*Assistant Examiner* — Tanzim Imam
(74) *Attorney, Agent, or Firm* — Cozen O'Connor

(57) ABSTRACT

System (10) for automatically packaging items varying in size and number for shipment, comprising a unit (32) for acquiring size information of one or more item(s) to be packaged, an inner packaging material feeding unit (24) for feeding an inner packaging material, an outer packaging material feeding unit (26) for feeding an outer packaging material, a first wrapping station (16) for wrapping said inner packaging material around one or more item(s) to be packaged to create an inner packing surrounding the item(s) in a first direction and a second wrapping station (18) for wrapping said outer packaging material around said inner packing to create an outer packing surrounding the inner packing in a second direction, said second direction being substantially perpendicular to said first direction, wherein
(Continued)

the first and the second wrapping stations are adapted to form said inner packing and said outer packing such that the inner and the outer packing form a combined package enclosing the packaged item(s) from all sides.

28 Claims, 9 Drawing Sheets

(51) Int. Cl.

| | |
|---|---|
| ***B65B 11/20*** | (2006.01) |
| ***B65B 43/12*** | (2006.01) |
| ***B65B 43/14*** | (2006.01) |
| ***B65B 49/00*** | (2006.01) |
| ***B65B 61/00*** | (2006.01) |
| ***B65B 61/20*** | (2006.01) |
| ***B65B 49/04*** | (2006.01) |

(52) U.S. Cl.
CPC ..... *B65B 43/145* (2013.01); *B65B 49/00* (2013.01); *B65B 49/04* (2013.01); *B65B 61/005* (2013.01); *B65B 61/20* (2013.01); *B65B 2210/04* (2013.01)

(56) References Cited

U.S. PATENT DOCUMENTS

| | | | | | |
|---|---|---|---|---|---|
| 3,442,372 | A | | 5/1969 | Carmichael et al. | |
| 3,531,907 | A | * | 10/1970 | Orzechowski | B65B 59/02 53/456 |
| 4,627,223 | A | * | 12/1986 | Janhonen | B65D 75/38 206/441 |
| 4,757,666 | A | * | 7/1988 | Janhonen | B65B 11/004 52/176 |
| 5,131,210 | A | * | 7/1992 | Kiya | B65B 27/125 100/247 |
| 5,248,034 | A | * | 9/1993 | Janhonen | B65D 5/0245 206/424 |
| 5,947,278 | A | * | 9/1999 | Sawhney | A61C 19/006 206/216 |
| 7,124,554 | B2 | * | 10/2006 | Biondi | B65B 61/20 53/135.1 |
| 2005/0115202 | A1 | | 6/2005 | Mertz, II et al. | |
| 2014/0345235 | A1 | * | 11/2014 | Yamazaki | B65B 5/02 53/462 |
| 2015/0225110 | A1 | * | 8/2015 | Ponti | B65D 5/20 53/456 |

FOREIGN PATENT DOCUMENTS

| | | | | | |
|---|---|---|---|---|---|
| DE | 698 17 577 | T2 | | 6/2004 | |
| EP | 0273240 | A2 | | 7/1988 | |
| EP | 0 342 477 | A1 | | 11/1989 | |
| EP | 0 393 406 | B1 | | 9/1993 | |
| EP | 2805892 | A1 | | 11/2014 | |
| GB | 911273 | A | | 11/1962 | |
| JP | WO 2013108829 | A1 | * | 7/2013 | B65B 5/02 |
| WO | 2013/108829 | A1 | | 7/2013 | |
| WO | 2014/117820 | A1 | | 8/2014 | |

OTHER PUBLICATIONS

Written Opinion, dated May 19, 2016, for corresponding PCT/EP2015/074029, 5 pages.

* cited by examiner

Fig. 2A
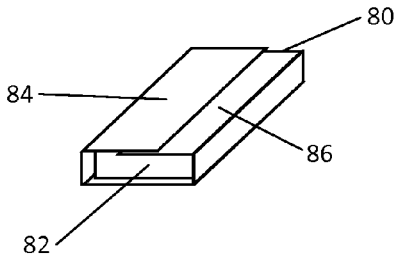
Fig. 2B
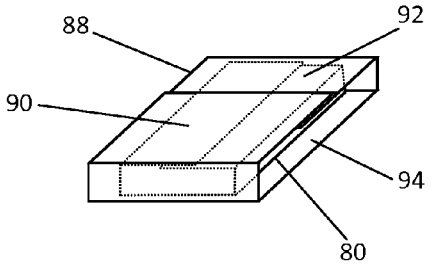
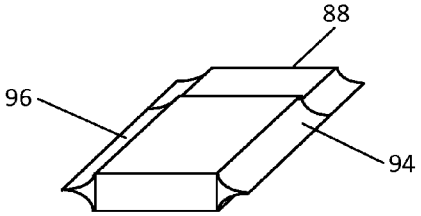
Fig. 2C
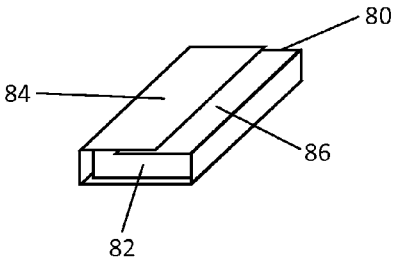
Fig. 3A
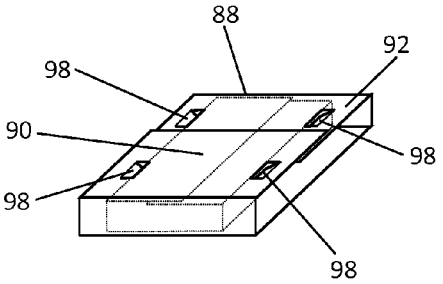
Fig. 3B

SYSTEM AND METHOD FOR AUTOMATICALLY PACKAGING ITEMS VARYING IN SIZE AND NUMBER FOR SHIPMENT

TECHNICAL FIELD OF THE INVENTION

The invention relates to a system and a method for automatically packaging items that vary in size and number for shipment.

BACKGROUND OF THE INVENTION

Mail ordering has become a widely used way of buying goods. More and more companies offer virtual department stores, in which the customers can electronically put goods in a shopping cart that later will be transferred by the respective company into an dispatch order, so that in a warehouse a shipment comprising the items ordered (and sometimes additional items such as samples, vouchers, invoices, etc.) can be assembled based on the respective dispatch order.

While assembling a shipment in a warehouse is nowadays often done more or less fully automated, packaging the items to be shipped is still a challenge, in particular when a shipment comprises several items of different sizes and in different quantity. Often, the items to be packaged are provided automatically to a person packaging the items manually. Depending on the size and number of the items, the person selects a suitable box size. Generally the box is a cardboard box that upon packaging is assembled from a corresponding cardboard blank.

To automate the packaging process even in cases where the items vary in size and number, in WO 2014/118594 A1 a system has been proposed that allows creating a custom sized box from a roll or a stack of cardboard by cutting out a custom sized blank, from which then a suitable box is folded automatically. While this system works perfectly well for numerous applications, there is room for improvement with respect to the amount of material needed for producing a box.

DISCLOSURE OF THE INVENTION

It is an object of the invention to provide a system and a method allowing automatically packaging one or more items in a fast, economical and environment friendly way by creating a custom sized package while producing little or no waste material upon creating the package from suitable packaging material.

This object is achieved with a system according to claim 1 respectively with a method according to claim 11. The respective dependent claims refer to advantageous embodiments of the respective independent claims.

The invention is based on the idea that by wrapping a first and a second packaging material, which—as will be explained later—may be the same material or different materials, around one or more item(s) to be packaged such that the first and the second packaging material surround the item(s) in two different directions, in particular in directions that are perpendicular to each other, a package fully enclosing the item(s) can easily be created. This idea as well as advantages and different variations of the invention will become apparent from the following description of preferred embodiments in conjunction with the drawings.

It should be understood that the term "wrapping" resp. "wrapping around" as used herein is meant to comprise all forms of forming the packaging material around the item(s) to be packaged, while the actual way of performing this wrapping depends in particular on the type of packaging material used. Generally, at least the outer packaging material will be cardboard, so that the "wrapping around" is done by folding the cardboard. It should also be understood that the term "packing" is used herein to denote a part of a package, while "package" denotes the ready to ship package that fully encloses the item(s) to be shipped. The term "shipment" is used to denote an assembly of items that shall be shipped.

BRIEF DESCRIPTION OF THE DRAWINGS

FIG. 2 shows schematically different stages during a packaging process according to the invention.

FIG. 3 shows schematically different stages during another packaging process according to the invention.

DESCRIPTION OF PREFERRED EMBODIMENTS

Figure 1:
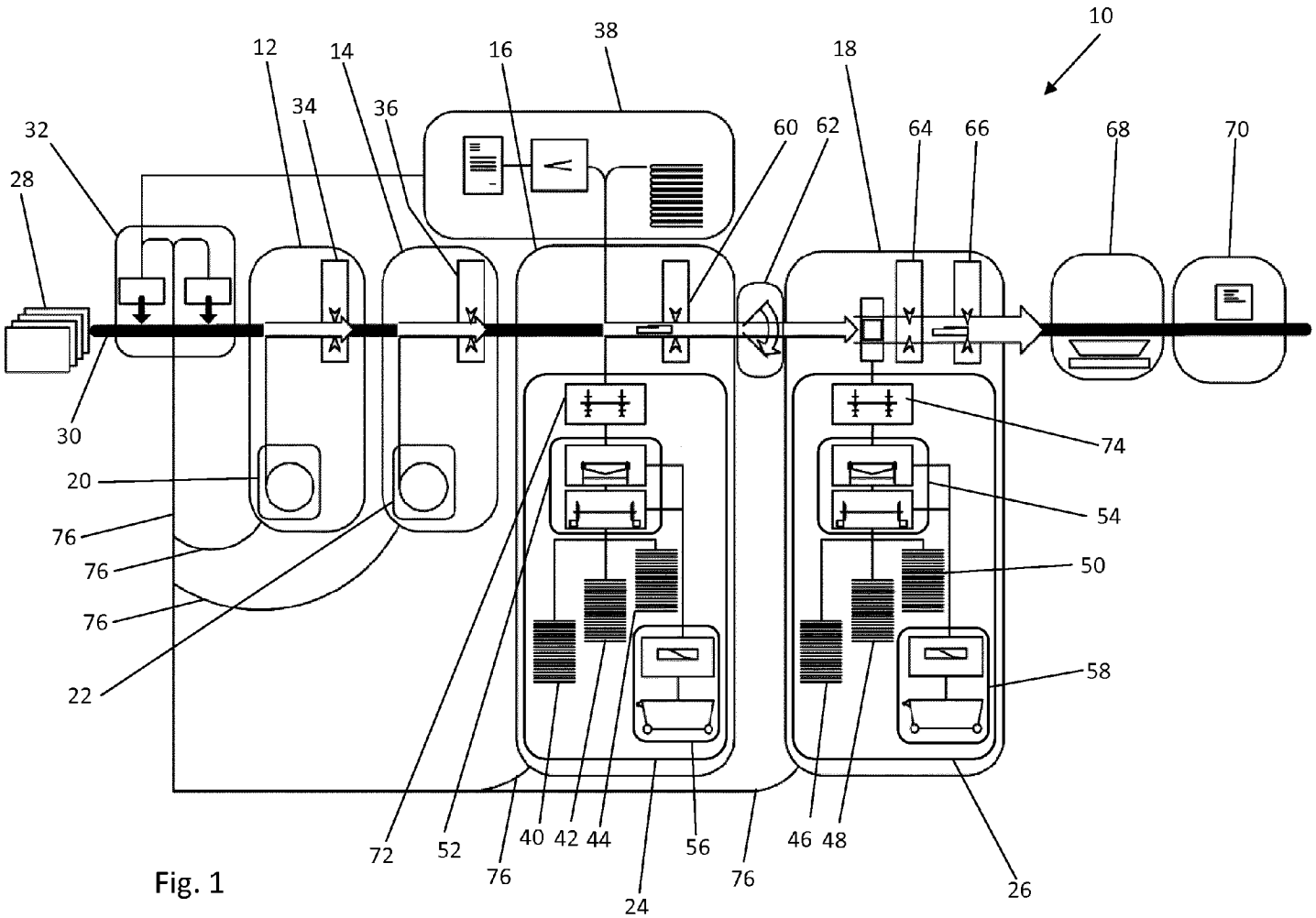
FIG. 1 shows very schematically a diagram of a first arrangement of the different units and stations of a system according to the invention.

FIG. 1 shows schematically a first preferred arrangement of the different units and stations of a system 10 for automatically packaging items varying in size and number for shipment.

In this embodiment, four wrapping stations 12, 14, 16 and 18 are foreseen. Each wrapping station is supplied with respective packaging material by a corresponding packaging material feeding unit 20, 22, 24 and 26.

System 10 further comprises an item reception station 28, at which one or more items to be packaged are put on suitable transportation means for being transported through the further stations of the system to be packaged. Such transportation means may in particular comprise one or more conveyer belts 30.

When the system is run, one or more items received at the item reception station 28 are scanned at a scanning station 32, which serves as a unit for determining information in particular on the size of the respective item(s) to be packaged. The information may be transmitted to the respective wrapping station via communication lines, schematically indicated by 76. Of course, such information may also be distributed using wireless communication. Additional information such as the total weight of the shipment may also be acquired and can be used in various ways, for example for checking the completeness of the shipment or for determining, which packaging material is to be used.

The scanning station 32 may comprise a barcode reader and/or a 3D-scanner and/or any other kind of detectors that allow acquiring information on the characteristics, in particular the dimensions of the item(s) to be packaged. From barcodes shown on the item(s) information about the dimensions of the item(s) can be obtained if this information is provided in a database accessible for the system. Of course, the system may form part of a semi or fully automated warehouse, so that information about the dimensions of the item(s) to be packaged need not to be obtained by a scanning station 32, but would be known to the system already from the order details for assembling the shipment, if a corresponding database contains size information on the item(s) forming the shipment. However, as the exact arrangement of a plurality of items forming a shipment may be unknown, providing means for actually measuring the dimension will be preferred in most cases.

With the information about the size of the item(s) to be packaged, the system can automatically calculate the minimum dimensions of the packaging material to be used. In the shown embodiment, once the dimensions of the item(s) have been acquired by the scanning unit 32, the item(s) enter wrapping station 12, in which a foil provided by the feeding unit 20 can be wrapped around the item(s), if the operator of the system has predetermined this.

The invention advantageously allows the operator a huge variety of options to optimize the packaging process not only in terms of minimizing the amount of material necessary for creating a package that is ready for shipment, but also to obtain optimal protection of the item(s) as needed. Hence, the operator of the system can predetermine that certain goods will always be wrapped in foil, for example to provide a special protection against humidity, or that foil is used depending on the address, to which the shipment is to be sent, since this address may be linked to certain transportation ways and certain transportation means, due to which it might be likely that a package will be subjected to humidity.

Wrapping station 12 comprises a sealing unit 34 that fixes the foil in a position surrounding the item(s). Depending on the type of foil used, the sealing unit may be a heater to shrink the foil, a welder to weld together two parts of the foil, a unit applying glue to bond together the free ends of the foil, an adhesive strip applicator or any other suitable device.

In the shown embodiment of a system 10 according to the invention, the item(s) that—as described—may or may not have been wrapped in foil at wrapping station 12 then enter wrapping station 14, in which, depending on the predetermined settings for the respective item(s), protective bubble paper or another shock absorbing material supplied by the respective packaging material feeding unit 22 can be wrapped around the item(s). Station 14 also includes a sealing unit 36, which is adapted to fix the respective material used around the item(s). If bubble paper is used, such sealing unit may apply a line of hot melting glue to one free end of the bubble paper wrapped around the item(s) to stack it to the other free end. Obviously, depending on the specific needs of the operator of the system, other packaging material, like gift paper, packing paper etc. may be fed to station 12 or station 14 or may be fed to a further wrapping station.

It should be understood that all packaging material feeding units 20, 22, 24 and 26 may generally be adapted to provide either "endless" packaging material from a roll or from a stack of zig-zag folded material, in case of which a cutting unit will be foreseen to cut off the necessary amount of packaging material as needed. Depending on the particular needs of the operator of such system, it may also be foreseen that instead of endless packaging material, precut sheets or blanks are used. As will be described in conjunction with the wrapping stations 16 and 18, the corresponding packaging material feeding units may even be adapted to feed a variety of different sheets or blanks.

Similar to the use of the wrapping station 12, using the wrapping station 14 is optional and may depend on the item(s) to be packaged. For example, if only books are to be packaged, no special shock protection by bubble paper or the like may be necessary. Hence, the operator may predetermine certain options for certain types of item(s), so that the system in operation automatically determines, if for example foil or bubble paper or both or none of them are to be used for creating a specific package.

In the shown embodiment, the item(s), which at this point in time may already be pre-packed either in foil or in bubble paper or in both or in none of them, will enter wrapping station 16, which is supplied with packaging material by packaging material feeding unit 24. A document feeder 38 is foreseen to provide, depending on the item(s) to be packaged, documents like delivery notes, invoices, vouchers, advertising material such as catalogues and the like. Such documents will be placed on or next to the item(s) and will then be packaged together with the item(s).

Optionally, a printer and a folder can be provided for printing and folding document(s) to be enclosed with the item(s) to be packaged.

As schematically indicated by the stacks 40, 42 and 44, the packaging material feeding unit 24 is adapted to provide cardboard blanks of different sizes and/or different designs. Similarly, packaging material feeding unit 26 is also adapted to provide cardboard blanks of different sizes and/or different designs using cardboard from one of the stacks 46, 48 and 50.

The stacks 40-50 may be stacks of zig-zag folded cardboard or of single cardboard blanks or any other suitable supply of cardboard. Although in the schematic drawing all stacks 40-50 look similar, the dimensions and/or the designs of the respective cardboard may be different. For example, the stacks may have different widths in order to easily create different sizes of packages without wasting too much or even any material. Depending on the type of business the operator of the system runs, the packaging material in the stacks may have different designs and may in particular be branded with different brand names, which is useful in so called "drop shipping", in which a company assembles and ships items to customers of different companies under the brand name of the respective company, so that the customer, who has ordered items with company A, receives the items in a customized package showing the brand name of company A, while in fact the shipment has been effected by company B, which may do the same for companies C, D etc.

As the expert will easily understand, the invention advantageously gives the operator a huge variety of options for choosing respective packaging material, and of course instead of the shown stacks 40, 42, 44, 46, 48 and 50, more stacks of different materials may be accessible in each packaging material feeding unit, and the material may not be in the form of stacks, but can as well be in the form of rolls or other forms.

In the shown embodiment, both packaging material feeding units 24 and 26 each comprise a cardboard cutting unit 52 and 54, which in this embodiment are adapted to cut cardboards in two dimensions to adjust both, the widths and the lengths of a cardboard blank that is to be used for forming an inner respectively an outer packing. Obviously, in particular when cardboard is supplied in different widths, adjusting the widths by cutting may not be necessary. Also, if the cardboard is supplied already in single sheets, no cutting in the lengths direction may be necessary.

Cardboard supplied in single sheets may already be provided with crease lines to facilitate folding. However, as in the most preferred embodiments the sizes of the packages created always vary, both packaging material feeding units 24 and 26 may comprise means 72, 74 for producing crease lines on cardboard to facilitate folding as needed. Such means are known per se, for example from WO 2014/117816 A1 or WO 2014/188010 A2, the disclosure of both documents shall be considered incorporated herein by reference. An expert in the art will easily understand that crease lines can not only be used to facilitate folding, but also to enhance stiffness, in particular of corrugated cardboard. For example, if cardboard from a zig-zag folded stack is used, the cardboard may already comprise crease lines at unwanted positions. If short crease lines are indented perpendicular to the unwanted crease lines, stiffness may be sufficiently enhanced to avoid folding the cardboard at unwanted positions.

Cutting units 52 and 54 are connected with respective waste cutters 56 and 58 that are adapted to cut any waste material in small pieces to facilitate waste disposal.

In wrapping station 16, the items, either pre-packed or not, are placed in the center of a rectangular cardboard blank fed to station 16 by feeding unit 24 such that, with respect to the direction of transportation in the station 16, the cardboard blank extends to the left and to the right of the item(s) and hence forms flaps, which can easily be folded around the item(s) automatically, as will be described later. A sealing unit 60 provides glue, in particular hot melted glue, or double-sided adhesive tape to one of the flaps, so that the finally folded cardboard not only completely surrounds the item(s) in a first direction, but forms a closed frame having a rectangular cross section. This frame can be regarded as one "inner packing" in the sense of the invention, as in this embodiment of the invention it will form with an outer packing formed in station 18 a package that fully encloses the packaged item(s). However, it is apparent for an expert in the art that, depending in particular on the item(s) to be packaged, it may not be necessary to form such inner packing with the station 16, namely in cases in which the item(s) has/have already been packaged in at least one of the stations 12 or 14. Hence, each of the stations 12, 14 and 16 can be operated as "first wrapping" station forming an inner packing as defined in the claims. It is therefore also apparent for an expert in the art that the final package may be comprised by different materials such as in particular a foil or a shock absorbing sheet forming an inner packing and cardboard forming an outer packing.

The inner packing is then processed by transportation direction changing means 62, which are arranged just before the wrapping station 18 and which are adapted for changing the direction of transportation of the inner packing by 90°.

As will become apparent from the following description, in particular the description of FIG. 4, changing the direction of transportation facilitates wrapping outer packaging material around the inner packing formed in this embodiment by the cardboard frame created in wrapping station 16. It will be understood by experts in the art that it is also possible to wrap an outer packaging material around the inner packing without changing the direction of transportation, but by changing the direction of transportation a rectangular cardboard blank can very easily be folded around the inner packing on the fly in a similar manner as with wrapping station 16.

It will also be understood by experts in the art that "changing the direction of transportation" is a relative term relating to the direction of transportation as seen by the item(s) respectively by the inner packing, such that the absolute direction of transportation may or may not change. Said means 62 may for example comprise guiding means to guide the inner packing from a first conveyer belt onto a second conveyor belt that runs in a direction substantially perpendicular to the direction of the first conveyor belt as depicted in FIG. 4. Said means 62 may also comprise means for turning the inner packing on the conveyor belt 30 by 90°.

In wrapping station 18, a rectangular cardboard blank fed to station 18 by feeding unit 26 is placed underneath the center of the packing formed in station 16 such that, with respect to the direction of transportation in the station 18, the cardboard blank extends to the left and to the right of the packing and hence forms flaps, which again can easily be folded around the packing automatically, as will be described later.

In this specific embodiment, wrapping station 18 comprises a joining unit 64 for attaching a portion of the material forming the outer packing, in this case a portion of a rectangular cardboard blank, to a portion of the material forming the inner packing, which in this case is the cardboard folded in station 16 to form a rectangular frame. This joining unit simply puts some hot melting glue or double-sided adhesive tape onto a portion of either one of the inner or the outer packaging material in a region where they overlap prior to putting the inner packing onto the outer packing. In this simple way, it can be prevented that in the final package, the inner packing falls out of the outer packing surrounding it. However, the inner packing may be held in a fixed position with respect to the outer packing also in other ways, as will be described in conjunction with FIG. 2 and FIG. 3.

A sealing unit 66 provides glue, in particular hot melted glue, or double-sided adhesive tape to one of the flaps, so that the finally folded cardboard not only completely surrounds the item(s) in a second direction, but forms another closed frame having a rectangular cross section.

When the package thus created leaves wrapping station 18, it may be subjected to some further automated processes, in particular the final weight of the package may be determined by a weighing station 68. The information thus acquired can not only be used to determine postage, but also to perform a plausibility check by comparing either the weight of the shipment upon entering the system, if the weight was measured at that time, and/or by comparing the actual weight with a theoretical weight calculated from known masses of the item(s) forming the shipment and information on the packaging material used.

At labeling station 70, an address label may be attached to the package either by printing address and/or postage information directly on the package or by attaching a corresponding label to it.

In an advantageous embodiment, the system may further comprise supervising means for supervising a packaging process performed by the system. The already-mentioned weighing of the shipment can form part of such supervision. It may be foreseen that one or more cameras document the packaging process. In particular, upon reception of the item(s) forming the shipment at the item reception station 28 and/or upon forming the inner packing at packing station 16 pictures may be taken to document, which item(s) has/have been packaged.

System 10 creates, as described above, an inner packing surrounding the item(s) in a first direction and an outer packing surrounding the inner packing in a second direction, such that the inner and the outer packing form a combined package enclosing the packaged item(s) from all sides. It is obvious that the terms "surrounding in a first/second direction" are relative terms and relate to the finally formed packages, while, as described above, the flaps extending to the left and the right of the item(s) in wrapping station 16, respectively to the left and to the right of the inner packing in wrapping station 18, are both first folded upwardly and then pushed downwards. Hence, the flaps initially extending to the left are folded around the item(s)—seen in the direction of transportation through the wrapping station 16—to finally surround the item(s) clockwise, whereas the flaps initially extending to the right are folded around the item(s) counter-clockwise. However, the finally formed frame completely surrounds the item(s) in a first direction, which is different, namely preferably perpendicular to the direction in which the outer packing surrounds the inner packing. In this way, it is ensured that all sides of the items are enclosed by the package. It should be understood that wrapping stations 12 and 14 are "further wrapping stations" for wrapping further packaging material around the item(s) to be packaged, while wrapping stations 16 and 18 are first and second wrapping stations for applying the inner and the outer packaging material.

FIGS. 2 and 3 show very schematically different stages during two slightly different packaging processes according to the invention. In FIG. 2A, an inner packing 80, for example from cardboard or packaging paper, has been formed around an item 82. Preferably, flap 84 of inner packing 80 has been glued to flap 86.

In FIG. 2B, an outer packing 88, preferably from cardboard or stiff packing paper, has been formed around inner packing 80, surrounding the inner packing in a direction which is perpendicular to the direction in which inner packing 80 surrounds item 82. Flap 90 of outer packing 88 has preferably been glued to flap 92. In this embodiment, outer packing 88 protrudes at both sides, which open towards inner packing 80, and forms two protruding margins 94 and 96. As explained, the packaging material forming outer packing 88 may be attached, in particular glued, to the material forming the inner packing 80 to prevent that inner packing 80 could fall out of outer packing 88. However, alternatively or additionally, the left and right margins 94 and 96 may be deformed as shown in FIG. 2C to close the outer packing 88. To prevent the margins 94 and 96 from opening up again, the margins may either be folded or indented accordingly or a line of glue or a double-sided adhesive tape may be provided in the inner side of the margins 94 and 96 before closing the outer packing 88.

In FIG. 3A, again an inner packing 80 has been formed around item 82. In FIG. 3B, an outer packing 88 has been formed from cardboard having sufficient stiffness around inner packing 80. Indentations 98 have been indented into outer packing 88, which indentations form stops holding inner packing 80 in position with respect to outer packing 88. These indentations may be alternative or additional means to join the inner and the outer packing to prevent that the inner packing falls out of the outer packing during transportation.

FIG. 4 shows very schematically a diagram of another arrangement of different units and stations of a system 100 according to a further embodiment of the invention. In order to facilitate understanding of the drawing, a ground plane, on which the system is placed, is very schematically indicated by lines 102. System 100 comprises similar units and stations as system 10 depicted in FIG. 1, hence the description of already described units can be kept short. System 100 in particular comprises an item reception station 128, at which item(s) 82 to be shipped are received and put on transportation means (not shown) for feeding the item(s) through system 100. At a scanning station 132, information on the size of the items to be packaged is scanned.

System 100 further comprises an outer packaging material feeding unit 126, two inner packaging material feeding units 122 and 124, two transportation belts 130 and 131, transportation direction changing means 160, a first wrapping station 116 for wrapping said inner packaging material around item (s) 82 to create an inner packing surrounding the item(s) in a first direction, and a second wrapping station 118 for wrapping said outer packaging material around said inner packing to create an outer packing surrounding the inner packing in a second direction, said second direction being substantially perpendicular to said first direction. Details of the respective stations are shown in the enlarged views of FIGS. 4A, 4B, 4C, 4D and 4E, which are each taken from a different perspective to facilitate understanding of the operation of the system. As FIG. 4 is intended to facilitate understanding the working principle of the invention, details of the respective units and stations, such as in particular grippers for gripping cardboard blanks, etc., are not shown as such components are known to the expert in the art.

Figure 4A:
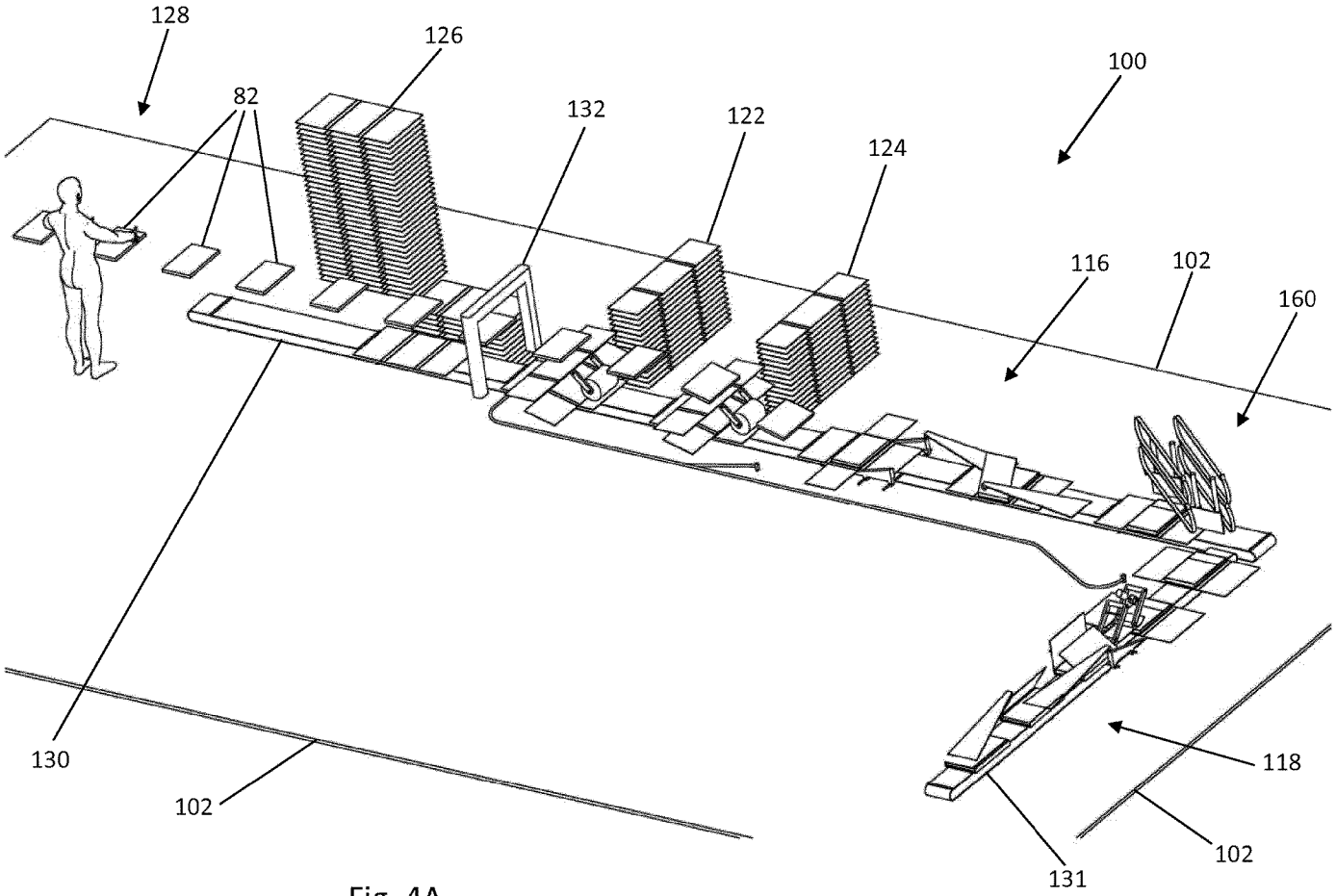
FIGS. 4A to 4F show very schematically another arrangement of different units and stations of a system according to a further embodiment of the invention.
Figure 4B:
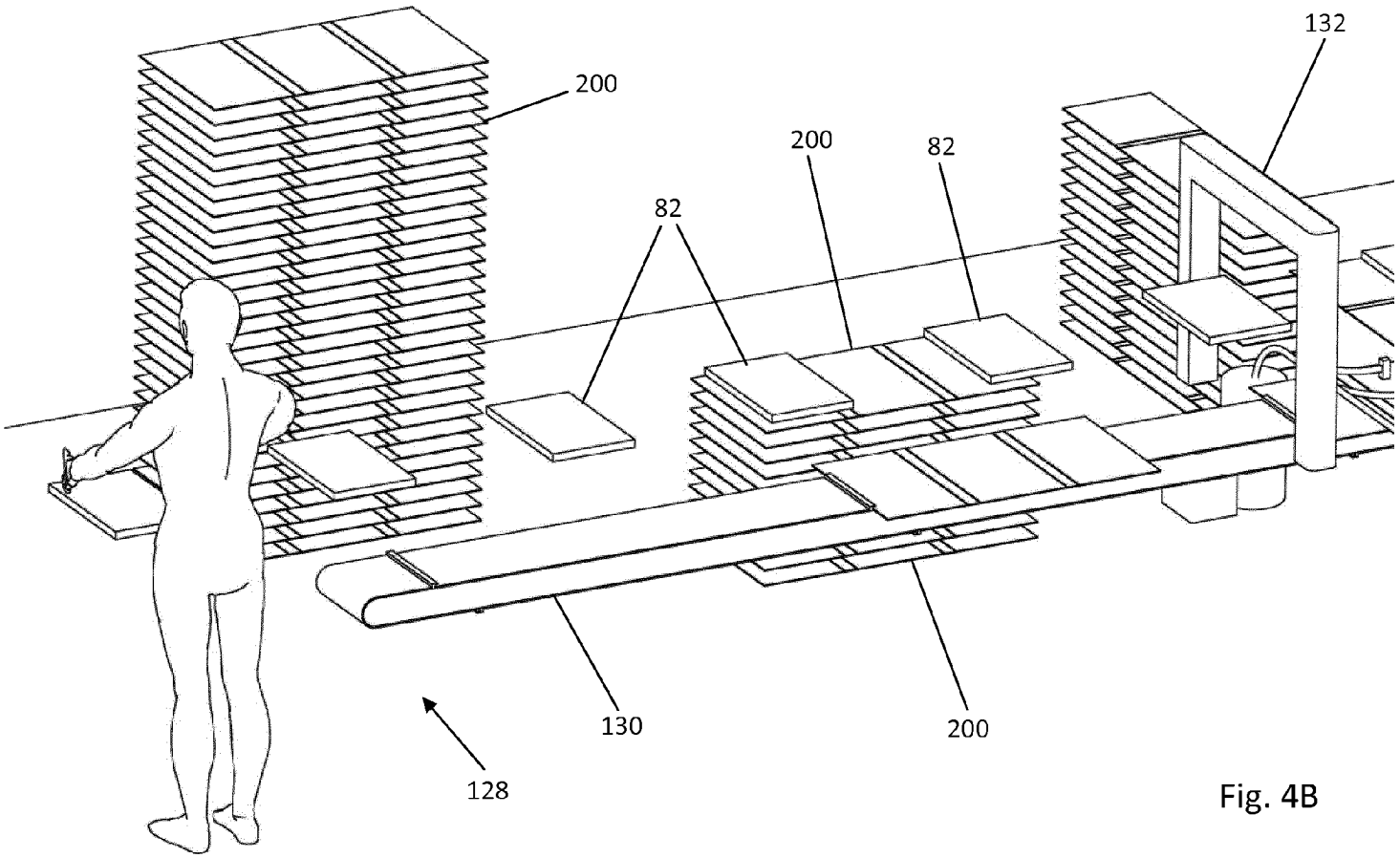
Figure 4C:
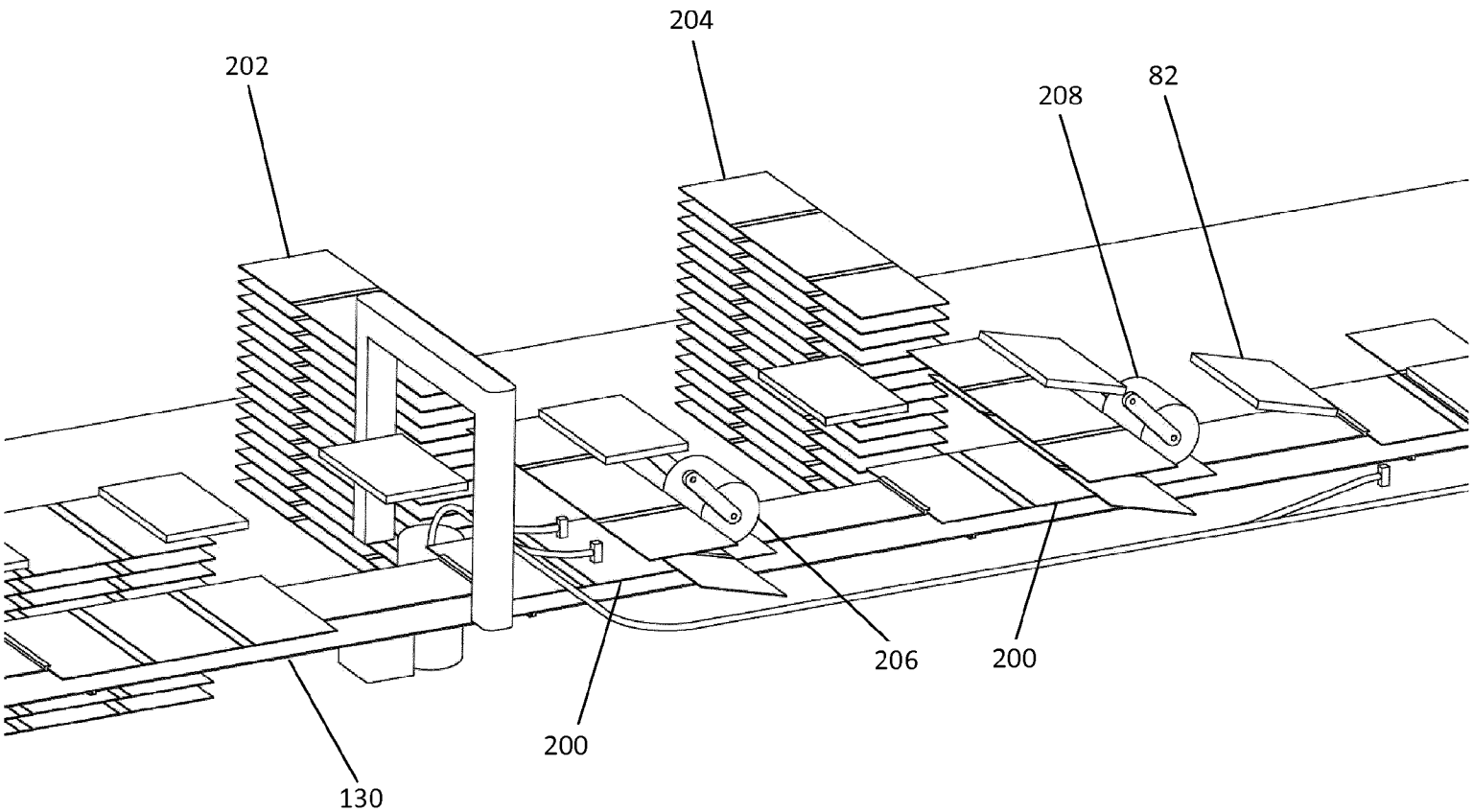

As schematically indicated in FIG. 4B, at item reception station 128 items are put (in this case manually) on suitable transportation means (not shown) for being transported through the system. FIG. 4B also shows that rectangular cardboard blanks 200, which in this case are used as outer packaging material, are placed on conveyor belt 130 such that the length direction of the cardboard blanks 200 (hereinafter called "outer blanks") corresponds to the direction of transportation of conveyor belt 130.

In this embodiment, the system comprises two stacks 202 and 204 of cardboard blanks of inner packaging material (hereinafter called "inner blanks"). The inner blanks may for example differ in size, although this is not shown in the very schematical drawing. The system automatically selects a suitable inner blank from either one of the stacks 202 and 204 and places it crosswise in the center of an outer blank 200. Item 82 is then placed on top of the inner blank. Before an inner blank from one of the stacks 202 and 204 is put on top of an outer blank 200, some holt-melt glue is applied to the center of outer blank 200 where the inner blank will be placed. Stacking of the inner and the outer blank is facilitated by pressure foam rollers 206 and 208.

Figure 4D:
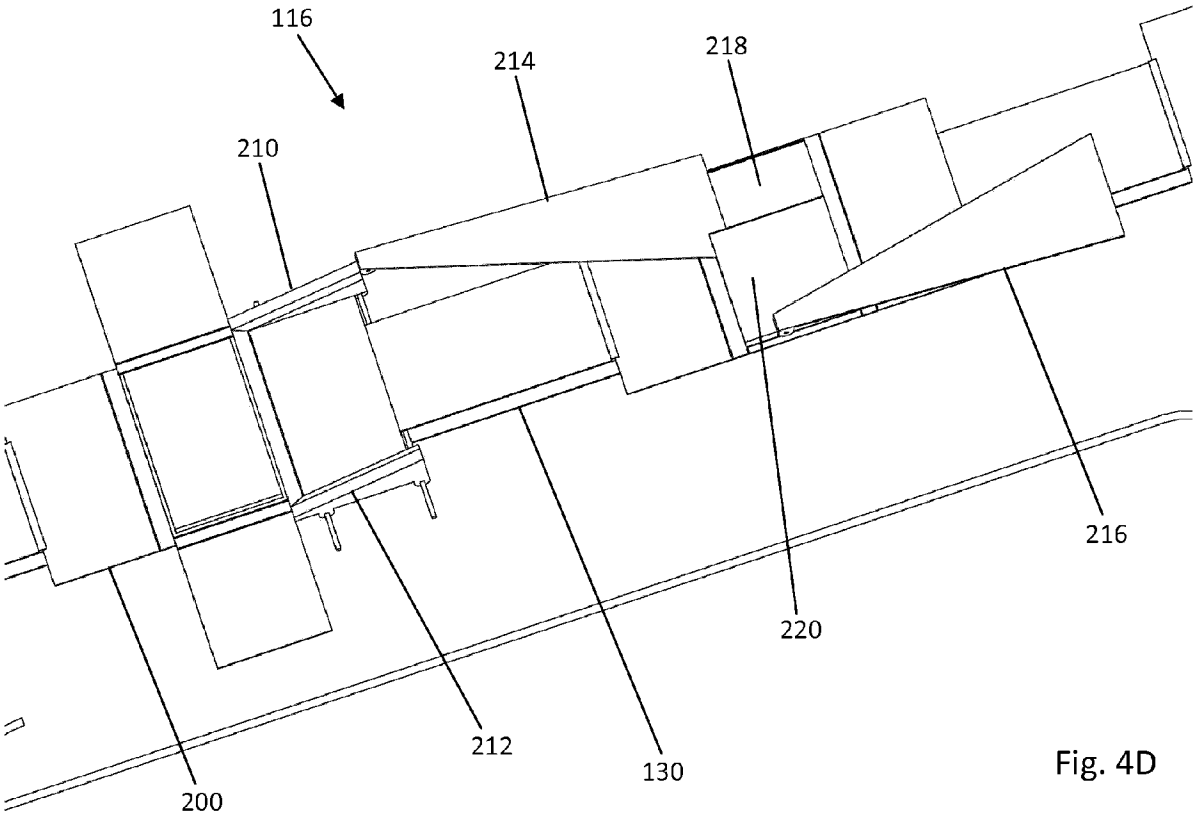

The assembly thus formed then enters the first wrapping station 116 as depicted in FIG. 4D. Fold skates 210, 212 keep outer blank 200 down, while pushing the parts of the inner blank that extend to the left and the right of conveyor belt 130 upwards. Closing skates 214 and 216 fold down the flaps 218 and 220 thus formed. A glue unit (not shown) provides some glue either on the outer side of flap 218 or on the inner side of flap 220 in a region, where those flaps will overlap, before flap 220 is folded on top of flap 218 to form an inner packing.

Figure 4E:
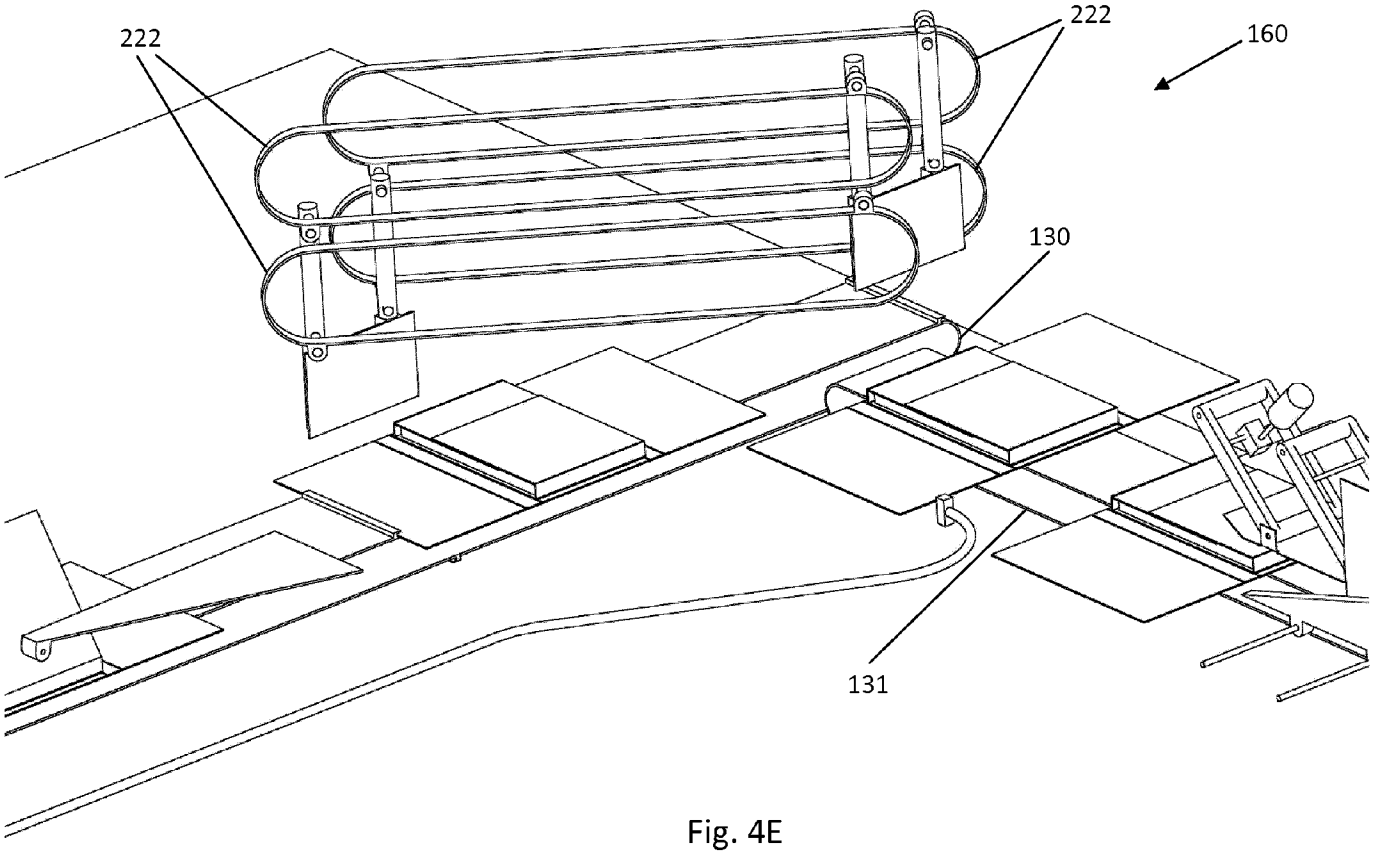

As depicted in FIG. 4E, transportation direction changing means, which are in this case formed by a number of revolving belts 222 convey the assembly of outer blank 200 and the inner packing to a second conveyor belt 131, the transportation direction of which being substantially perpendicular to that of conveyor belt 130.

Figure 4F:
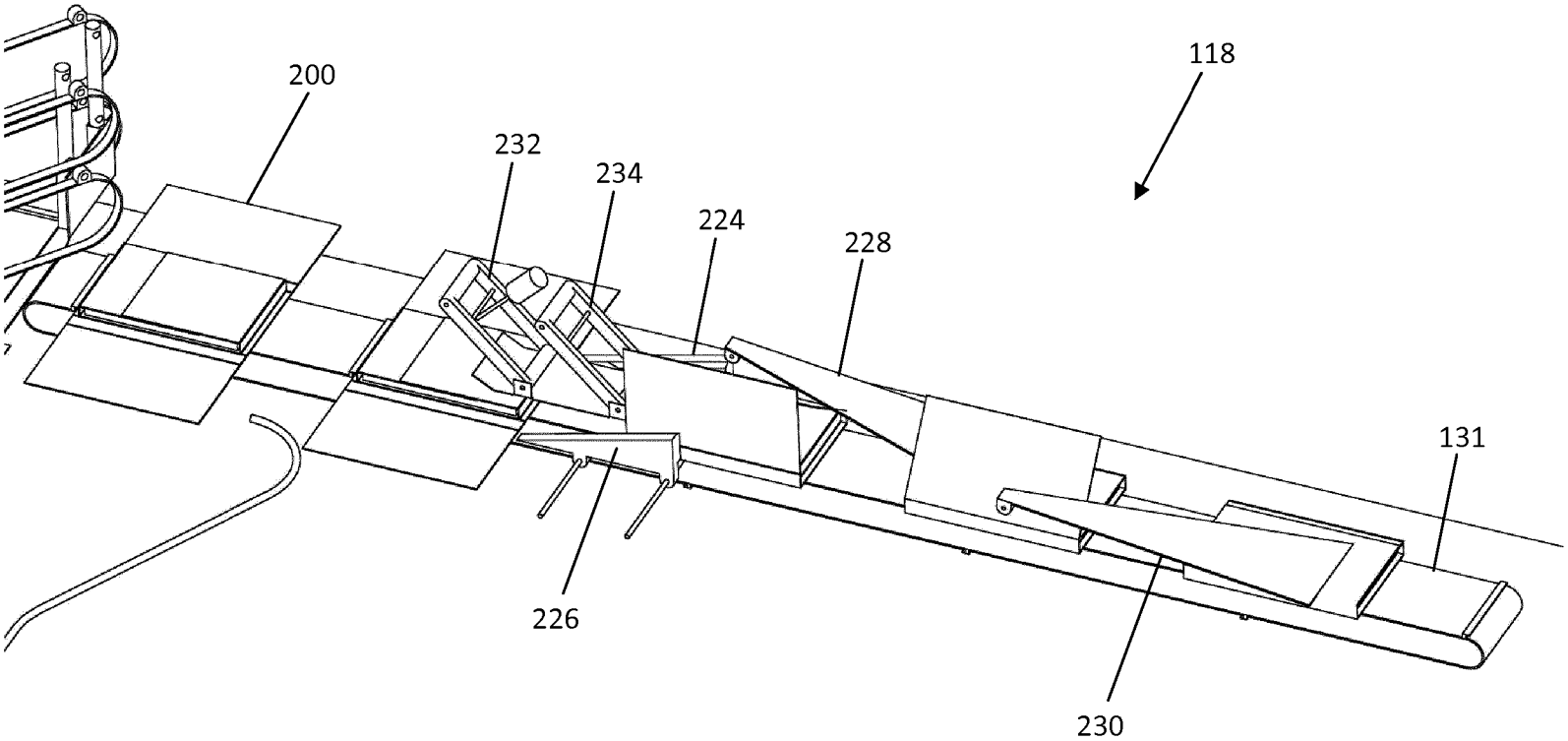

As depicted in FIG. 4F, folding skates 224 and 226 fold the portions of outer blank 200, which now, after changing the direction of transportation, extend to the left and the right of conveyor belt 131, upwardly. Closing skates 228 and 230 fold down the thus formed flaps similar to the way of operation of closing skates 214 and 216. Again, a glue unit (not shown) can be foreseen to provide some glue on one of the flaps forming the top of the outer packing to close the outer packing. To keep the inner packing down while lifting the flaps of outer blank 200 up, box pushers 232, 234 are foreseen.

While FIG. 4 very schematically shows a system of the invention, it is clear for the expert in the art that when creating a custom sized package, the width of the folding skates has to be adjusted to the width of the inner respectively the outer blank to be folded.

FIGS. 5A to 5D show cardboard blanks and packings created therefrom. Instead of cutting the cardboard blanks to length, the inner and outer flaps of the cardboard blank overlap more or less, dependent on the required dimensions of the package to be created. With this approach packages of varying height can be created with a fixed cardboard blank size and no cardboard cutting unit and waste handling is needed.

Figure 5A:
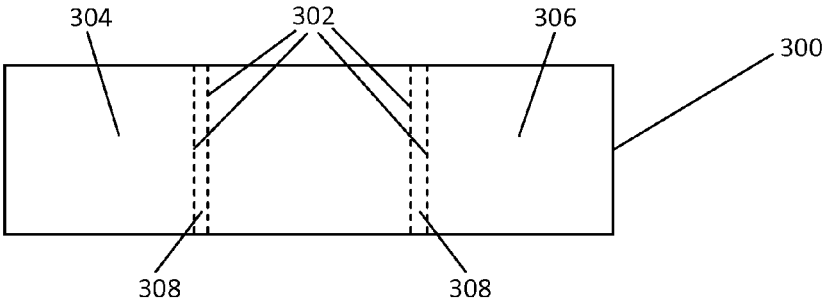
FIGS. 5A to 5D show using a blank of one size to form packages of various heights.
Figure 5B:
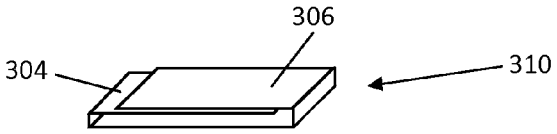

FIG. 5A shows a standard size cardboard blank 300, which has been provided with crease lines 302 for a low height packing such that both, the inner flap 304 and the outer flap 306, are relatively long, while the side panels 308 are relatively short. FIG. 5B shows the packing 310 created from the blank shown in FIG. 5A, in which the inner flap 304 and the outer flap 306 have a large overlap.

Figure 5C:
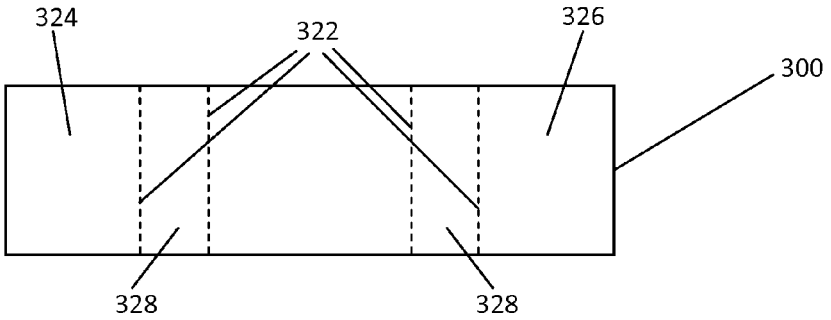
Figure 5D:
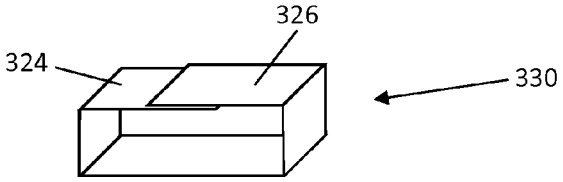

FIG. 5C shows the same sized cardboard blank 300, but prepared for a thicker (higher) packing. The crease lines 322 defining the side panels 328 are further spaced apart from each other, such that the inner flap 324 and the outer flap 326 are shorter than in FIG. 5A to allow an increased length of side panels 328. FIG. 5D shows a packing 330 created from the blank shown in FIG. 5C, which has an increased height, while the overlap of the inner flap 304 and the outer flap 306 has decreased.

With the blanks shown in FIGS. 5A and 5C, it is possible to create packings having variable heights without having to cut the cardboard blanks to size, as long as the overlap is sufficient to attach the inner and outer flap of the created packing together. As will be easily understood by an expert in the art, it is possible to provide such blank with the necessary crease lines once the information on the size of the item(s) to be packaged has been determined as described above.

Within the idea of the invention, numerous variations and embodiments are possible that relate for example to the number and arrangement of wrapping stations and packaging material supply units. Also, one or more diverters maybe foreseen that divert items to be packaged that are either too heavy or too big to be automatically packaged within the system, or that divert packages before putting address labels and postage on it, if it has been determined that the package is not properly closed.

Besides allowing creating custom sized and tight fitting packages on the fly, which hence reduce the need for filling material and also avoid unnecessary transportation volume, hence allowing to more economically transport shipments, while using as little packaging material as necessary, and while in particular being able to efficiently pack also rather thin or flat items, a major advantage of the invention is the modularity of the components forming the system, which easily allow to adapt the system to the needs of each customer.

The invention claimed is:

1. A system for automatically packaging items varying in size and number for shipment, the system comprising:

a unit for acquiring size information of one or more item(s) to be packaged, an inner packaging material feeding unit for feeding an inner packaging material, an outer packaging material feeding unit for feeding an outer packaging material, wherein the system is adapted for stacking the inner packaging material fed by the inner packaging material feeding unit on top of the outer packaging material fed by the outer packaging material feeding unit for providing a stack of the inner packaging material and the outer packaging material, wherein the system is further adapted for placing the item(s) to be packaged on top of the inner packaging material of the stack, a first wrapping station for wrapping said inner packaging material of the stack around the one or more item(s) to be packaged to create an inner packing completely surrounding the item(s) in a first direction, wherein a first free end portion and a second free end portion of the inner packing of the stack are fixedly attached to each other for closing the inner packing, a second wrapping station for wrapping said outer packaging material of the stack around said inner packing of the stack to create an outer packing completely surrounding the inner packing of the stack in a second direction, said second direction being perpendicular to said first direction, and a transportation direction changing means arranged after the first wrapping station and before the second wrapping station and adapted to change a direction of transportation of the stack of the inner packaging material and the outer packaging material provided with the item(s) to be packaged by 90°, wherein the first wrapping station is adapted to form said inner packing such that the inner packing is open at two sides and encloses the item(s) at four sides, wherein the second wrapping station is adapted to form said outer packing such that the outer packing is open at two sides and encloses the inner packing at four sides, and wherein the first and the second wrapping stations are adapted to form said inner packing and said outer packing such that the inner and outer packings form a combined package completely enclosing the item(s) from all sides.

2. The system according to claim 1, further comprising a scanning station that determines size information of the item(s) to be packaged.

3. The system according to claim 1, further comprising a joining unit for attaching a portion of the outer packaging material forming the outer packing to a portion of the inner packaging material forming the inner packing.

4. The system according to claim 1, further comprising at least one further packaging material feeding unit and at least one further wrapping station, wherein one of the inner packaging material feeding unit, the outer packaging material unit and the at least one further packaging material feeding unit is a cardboard blank supply unit adapted to provide cardboard blanks of different sizes and/or different designs to at least one of the first wrapping station, the second wrapping station, and the at least one further wrapping station.

5. The system according to claim 1, further comprising at least one cardboard cutting unit adapted to provide customized cardboard blanks to at least one of the first and the second wrapping stations.

6. The system according to claim 1, further comprising at least one further packaging material feeding unit for feeding a further packaging material and at least one further wrapping station for wrapping said further packaging material around said item(s) to be packaged, said at least one further wrapping station being arranged before the second wrapping station.

7. The system according to claim 1, further comprising a document feeder for feeding documents to the item(s) to be packaged before closing the outer packing.

8. The system according to claim 1, further comprising a subsystem for supervising a packaging process performed by the system, wherein the subsystem including at least one of a scanning station, a weighing station, and one or more cameras to document the packaging process.

9. The system according to claim 1, wherein the system comprises a first transportation means for transporting the stack of the inner packaging material and the outer packaging material provided with the item(s) to be packaged in the direction of transportation to the first wrapping station.

10. The system according to claim 9, wherein the system comprises a second transportation means for transporting the stack of the inner packaging material and the outer packaging material to the second wrapping station.

11. The system according to claim 10, wherein a direction of transportation of the second transportation means is perpendicular to a direction of transportation of the first transportation means.

12. The system according to claim 11, wherein the transportation direction changing means comprises guiding means adapted to guide the stack from the first transportation means onto the second transportation means.

13. The system according to claim 1, wherein the system comprises a first transportation means for transporting the stack of the inner packaging material and the outer packaging material provided with the item(s) to be packaged in the direction of transportation to the first wrapping station, and wherein the transportation direction changing means comprises a turning means adapted to turn the stack on the first transportation means by 90° after the first wrapping station and before the second wrapping station.

14. The system according to claim 9, wherein the first transportation means is a first conveyor belt.

15. The system according to claim 13, wherein the first transportation means is a first conveyor belt.

16. The system according to claim 10, wherein the second transportation means is a second conveyor belt.

17. A method for automatically packaging items varying in size and/or number for shipment, the method comprising:

acquiring size information of one or more item(s) to be packaged;

providing an inner packaging material and an outer packaging material;

stacking the inner packaging material on top of the outer packaging material to form a stack;

placing the item(s) to be packaged on top of the inner packaging material;

wrapping the inner packaging material of the stack around the item(s) to create an inner packing completely surrounding the item(s) in a first direction, such that the inner packing is open at two sides and completely encloses the item(s) at four sides, wherein a first free end portion and a second free end portion of the inner packaging of the stack are fixedly attached to each other to close the inner packing;

changing a direction of transportation of the stack of the inner packaging material and the outer packaging material by 90°, after creating the inner packing and before creating an outer packing; and wrapping the outer packaging material of the stack around the inner inner packing to create the outer packing completely surrounding the inner packing in a second direction, such that the outer packing is open at two sides and completely encloses the inner packing at four sides, wherein said second direction is perpendicular to the first direction, such that the inner and outer packings form a combined package completely enclosing the item(s) from all sides.

18. The method according to claim 17, further comprising:

attaching a rectangular sheet of the inner packaging material crosswise to a rectangular sheet of the outer packaging material, placing the item(s) to be packaged on the sheet of the inner packaging material in a region where the inner packaging material and the outer packaging material overlap, folding the two free end portions of the inner packaging material around the item(s), and folding two free end portions of the outer packaging material around the item(s).

19. The method according to claim 17, further comprising bonding a portion of the inner packaging material to the outer packaging material.

20. The method according to claim 17, further comprising wrapping the item(s) and/or the inner packing in a further packaging material.

21. The method according to claim 17, further comprising supplying documents to the item(s) before closing the outer packing.

22. The method according to claim 17, further comprising automatically selecting for the item(s) to be packaged at least one of the outer packaging material and the inner packaging material from a variety of packaging materials of different sizes and/or designs.

23. The method according to claim 17, further comprising cutting a custom sized blank from a stack or a roll of cardboard and using the blank to create the inner packing or the outer packing.

24. The method according to claim 17, wherein cardboard is used as packaging material for at least one of the outer packing and the inner packing, and wherein the method further comprises producing crease lines in the cardboard.

25. The method according to claim 17, further comprising producing indentations in the outer packing to fix a position of the inner packing in the outer packing.

26. The method according to claim 17, further comprising bonding together the first and second free end portions of the inner packing and/or two free end portions of the outer packing for closing the inner packing and/or the outer packing.

27. The method according to claim 17, further comprising deforming and closing the outer packing at sides which after wrapping the outer packaging material around the inner packing are open to the inner packing.

28. The method according to claim 17, wherein fixed-size packaging blanks are used as the or additionally to the inner packaging material and the outer packaging material, and wherein a variation in height of a package created from the fixed-size packaging blanks results in a variation of an overlap of outer ends of the packaging blanks after folding.

* * * * *